US011656564B2

(12) United States Patent
Ishio et al.

(10) Patent No.: US 11,656,564 B2
(45) **Date of Patent: *May 23, 2023**

(54) IMAGE FORMING APPARATUS WHICH INCLUDES A BELT HAVING AN ELECTROCONDUCTIVE LAYER

(71) Applicant: CANON KABUSHIKI KAISHA, Tokyo (JP)

(72) Inventors: Shohei Ishio, Tokyo (JP); Keisuke Ishizumi, Kanagawa (JP); Shinji Katagiri, Kanagawa (JP); Eiichi Hamana, Tokyo (JP); Noriaki Egawa, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/814,013

(22) Filed: Jul. 21, 2022

(65) Prior Publication Data

US 2022/0357686 A1 Nov. 10, 2022

Related U.S. Application Data

(63) Continuation of application No. 17/498,970, filed on Oct. 12, 2021, now Pat. No. 11,435,680.

(30) Foreign Application Priority Data

Nov. 12, 2020 (JP) ..... JP2020-189028

(51) Int. Cl.
*G03G 15/16* (2006.01)

(52) U.S. Cl.
CPC ..... *G03G 15/162* (2013.01); *G03G 15/1615* (2013.01)

(58) Field of Classification Search
CPC ..... G03G 15/162; G03G 15/1615
(Continued)

(56) References Cited

U.S. PATENT DOCUMENTS 10,168,645 B2 1/2019 Yoshida et al.
11,435,680 B2 * 9/2022 Ishio et al. ..... G03G 15/162
(Continued)

FOREIGN PATENT DOCUMENTS

JP 2010-197961 A 9/2010
JP 2014-178707 A 9/2014
(Continued)

*Primary Examiner* — Roy Y Yi
*Assistant Examiner* — Andrew V Do
(74) *Attorney, Agent, or Firm* — Venable LLP

(57) ABSTRACT

An image forming apparatus includes an endless belt including a base layer and an electroconductive layer positioned on an inner peripheral surface side of base layer and forming an inner peripheral surface of the belt, and a roller provided on the inner peripheral surface side of the belt and including a roller portion around which the belt is wound and which is formed of a metal material. The electroconductive layer contains a binder resin, an electroconductive agent, and a copper compound, and has surface resistivity of $5.0\times10^{6}\Omega/\square$ or less. The roller portion includes a base material of a first metal material comprising a first metal, and a coating layer which forms a surface contacting the electroconductive layer formed of a second metal material comprising a second metal. A difference in standard potential between the second metal and copper is smaller than that between the first metal and copper.

10 Claims, 5 Drawing Sheets

(58) Field of Classification Search
USPC ..... 399/302
See application file for complete search history.

(56) References Cited

U.S. PATENT DOCUMENTS

| | | | |
|---|---|---|---|
| 2016/0004192 | A1 | 1/2016 | Itoh et al. |
| 2019/0072880 | A1 | 3/2019 | Yoshida et al. |

FOREIGN PATENT DOCUMENTS

| | | | |
|---|---|---|---|
| JP | 2018-25621 | A | 2/2018 |
| JP | 2018-36624 | A | 3/2018 |

* cited by examiner (a)

(b)

IMAGE FORMING APPARATUS WHICH INCLUDES A BELT HAVING AN ELECTROCONDUCTIVE LAYER

CROSS-REFERENCE TO RELATED APPLICATIONS

This application is a continuation application of U.S. patent application Ser. No. 17/498,970, filed Oct. 12, 2021, which claims the benefit of Japanese Patent Application No. 2020-189028, filed on Nov. 12, 2020. Both prior applications are hereby incorporated by reference herein in their entirety.

FIELD OF THE INVENTION AND RELATED ART

The present invention relates to an image forming apparatus, such as a copying machine, a printer, or a facsimile machine, utilizing an electrophotographic type or an electrostatic recording type.

Conventionally, for example, as the image forming apparatus of the electrophotographic type, there is an image forming apparatus of an intermediary transfer type in which an intermediary transfer belt constituted by an endless belt fed for secondary transferring, into a recording material, a toner image primary-transferred from a photosensitive member is provided. In the following, the image forming apparatus of the intermediary transfer type will be further described as an example.

In such an image forming apparatus, for example, in order to simplify an apparatus structure and to improve an image quality, a constitution in which a current is capable of being caused to flow through the intermediary transfer belt with respect to a circumferential direction has been required in some instances. In Japanese Laid-Open Patent Application (JP-A) 2018-36624, in order to improve a transfer property, a constitution in which a low-resistant electroconductive layer for forming an inner peripheral surface of an intermediary transfer belt is provided in the intermediary transfer belt is disclosed.

By the constitution of JP-A 2018-36624, improvement in transfer property can be expected, but in a recent image forming apparatus extended in lifetime, further improvement in durability of the image forming apparatus has been required.

SUMMARY OF THE INVENTION

A principal object of the present invention is to provide an image forming apparatus which includes a belt having an electroconductive layer forming an inner peripheral surface of the belt and which is capable of improving durability thereof.

According to an aspect of the present invention, there is provided an image forming apparatus comprising: an endless belt including a base layer and an electroconductive layer positioned on an inner peripheral surface side of the belt than the base layer and forming an inner peripheral surface of the belt; and a roller provided on the inner peripheral surface side of the belt and including a roller portion around which the belt is wound and which is formed of an aluminum material, wherein the electroconductive layer contains a binder resin, an electroconductive agent, and a copper compound, and has surface resistivity of $5.0\times10^{6}\Omega/\square$ or less, and wherein the roller includes an alumite layer forming a surface contacting the electroconductive layer.

Further features of the present invention will become apparent from the following description of exemplary embodiments with reference to the attached drawings.

Figure 2:
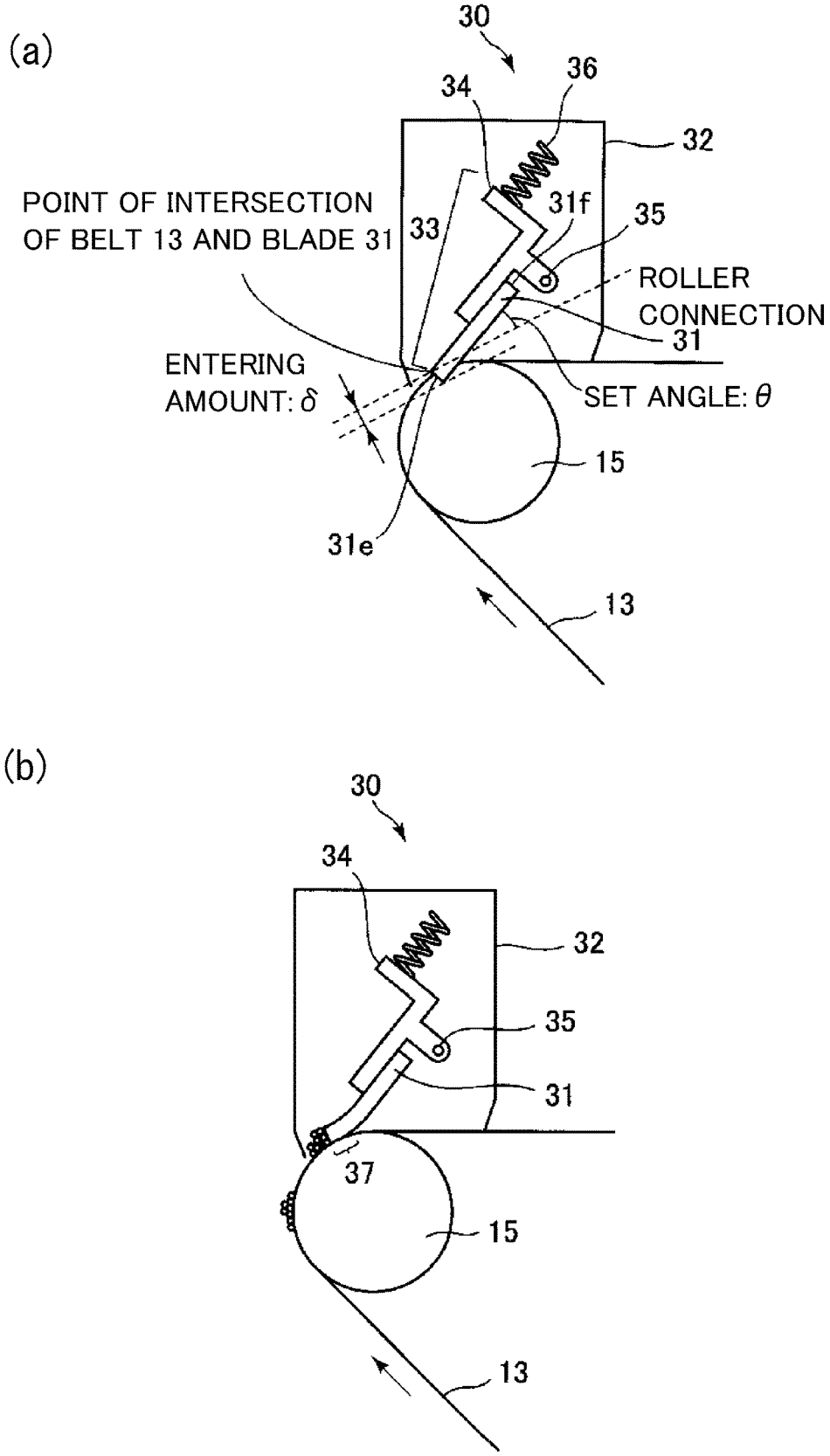

Parts (a) and (b) of FIG. 2 are schematic sectional views of a belt cleaning device.

Figure 3:
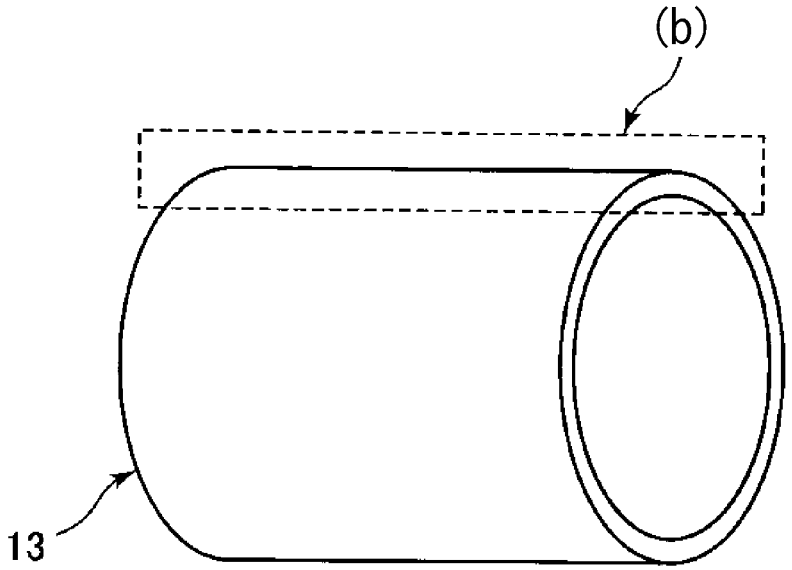
Figure 3:
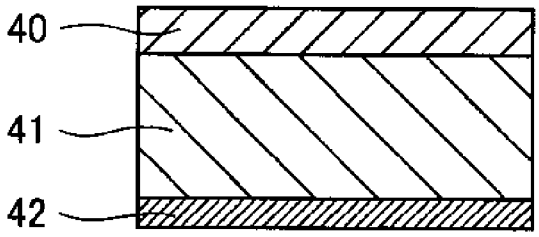

Parts (a) and (b) of FIG. 3 are a schematic perspective view and a schematic sectional view, respectively, of an outer appearance of an intermediary transfer belt.

Figure 4:
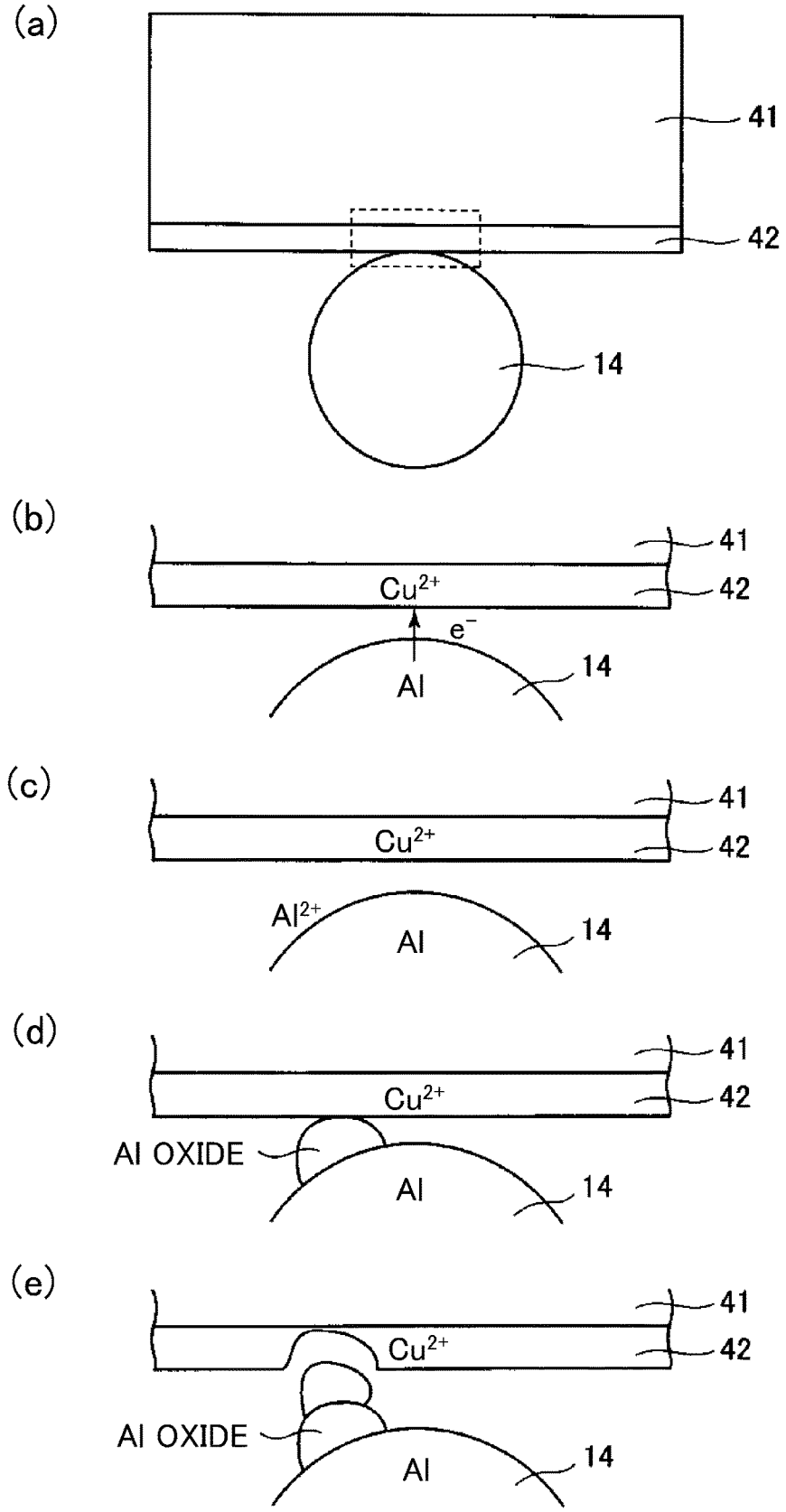

Parts (a) to (e) of FIG. 4 are schematic views for illustrating a problem.

Figure 5:
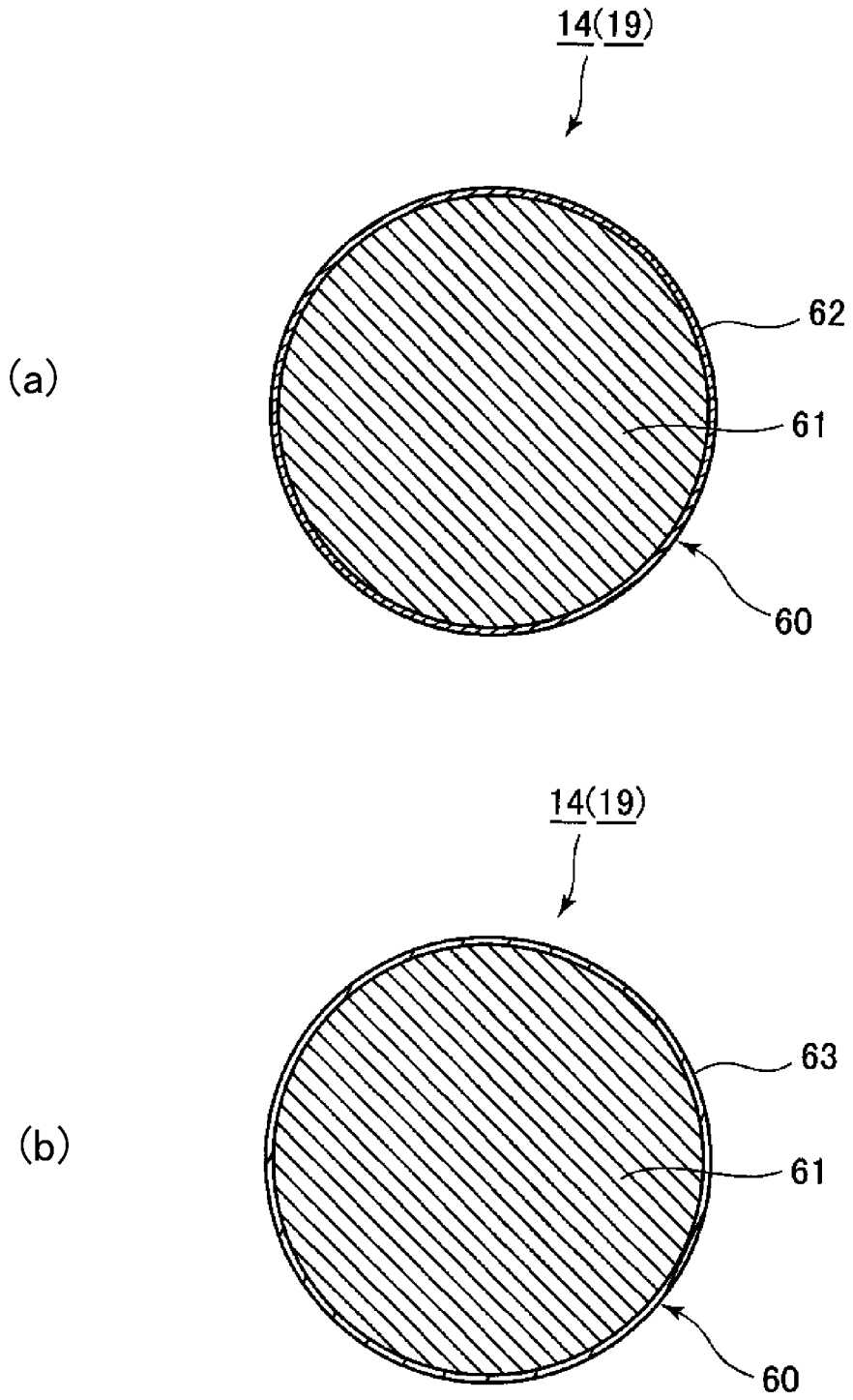

Parts (a) and (b) of FIG. 5 are schematic sectional views each for illustrating a structure of a roller.

DESCRIPTION OF THE EMBODIMENTS

In the following, an image forming apparatus according to the present invention will be described specifically with reference to the drawings.

Embodiment 1

1. Structure and Operation of Image Forming Apparatus

Figure 1:
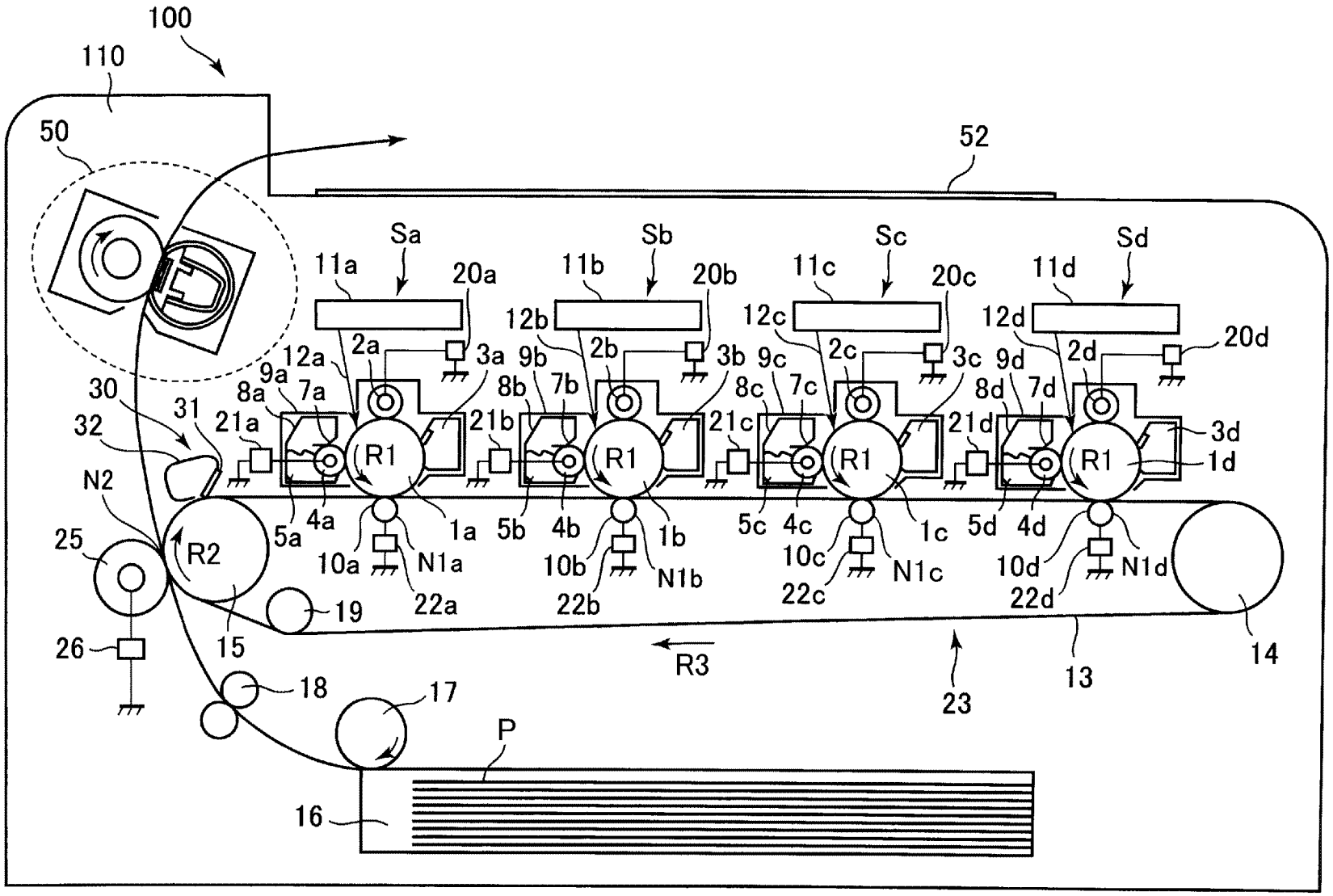
FIG. 1 is a schematic sectional view of an image forming apparatus.

FIG. 1 is a schematic sectional view of an image forming apparatus 100 of an embodiment 1. The image forming apparatus 100 of this embodiment is a laser beam printer of a tandem type in which a full-color image is capable of being formed by using an electrophotographic type and in which an intermediary transfer type is employed.

The image forming apparatus 100 includes, as a plurality of image forming portions (stations), first to fourth image forming portions Sa, Sb, Sc and Sd for forming colors of yellow (Y), magenta (M), cyan (C) and black (K), respectively. These four image forming portions Sa, Sb, Sc and Sd are disposed in line with certain intervals along a movement direction of an intermediary transfer belt 13 described later. As regards elements having the same or corresponding functions or constitutes in the respective image forming portions Sa, Sb, Sc and Sd, these elements are collectively described in some instances by omitting suffixes, a, b, c and d of reference numerals or symbols representing the elements for associated colors. In this embodiment, the image forming portions S are constituted by including photosensitive drums 1 (1*a*, 1*b*, 1*c*, 1*d*), charging rollers 2 (2*a*, 2*b*, 2*c* and 3*d*), exposure devices 11 (11*a*, 11*b*, 11*c*, 11*d*), developing devices 8 (8*a*, 8*b*, 8*c*, 8*d*), primary transfer rollers 10 (10*a*, 10*b*, 10*c*, 10*d*), drum cleaning devices 3 (3*a*, 3*b*, 3*c*, 3*d*), and the like which are described later.

The photosensitive drum 1 which is a rotatable drum type (cylindrical) photosensitive member (electrophotographic photosensitive member) is constituted by laminating a plurality of layers of functional organic materials. In this embodiment, the photosensitive drum 1 includes, as the layers of the functional organic materials, a carrier generating layer of generating carrier through sensitization, a charge transporting layer for transporting a generated charge, and the like. An outermost layer thereof is low in electrical conductivity and is almost insulative. The photosensitive drum 1 is rotated at a predetermined peripheral speed (process speed) in an arrow R1 direction (counter-clockwise direction) in the figure by receiving a driving force from a driving source (not shown). A controller (not shown) as a control means provided in the image forming apparatus 100 receives an image signal (image information), whereby an image forming operation is started. Then, the respective photosensitive drums 1*a* to 1*d* and a secondary transfer opposite roller 15 described later and the like start rotation thereof at predetermined peripheral speeds (process speeds) by driving forces (not shown). In this embodiment, the process speed is 200 mm/s.

The charging roller 2 which is a roller type charging member as a charging means contacts the photosensitive drum 1 and is rotated by rotation of the photosensitive drum 1. A surface (outer peripheral surface) of the rotating photosensitive drum 1 is electrically charged uniformly to a predetermined polarity (negative in this embodiment) and a predetermined potential. The charging roller 2 is connected to a charging voltage source 20. During the charging process, to the charging roller 2, a charging voltage (charging bias) which is a DC voltage of a predetermined polarity (negative in this embodiment) is applied by the charging voltage source 20. The charging roller 20 charges the surface of the photosensitive drum 1 by electric discharge generating in at least one of minute air gaps formed on an upstream side and a downstream side of a contact portion between the charging roller 2 and the photosensitive drum 1 with respect to a rotational direction of the photosensitive drum 1.

The charged surface of the photosensitive drum 1 is irradiated with a scanning laser beam 12 in accordance with an image signal by an exposure means 11, so that an electrostatic latent image (electrostatic image) in accordance with the image signal is formed on the photosensitive drum 1. In this embodiment, the exposure device 11 is constituted by a scanner unit for scanning the photosensitive drum surface with laser light by a polygonal mirror, and radiates the photosensitive drum 1 with the laser beam 12 modulated on the basis of the image signal.

The electrostatic latent image formed on the photosensitive drum 1 is developed (visualized) by being supplied with toner as a developer by the developing device 8 as a developing means, so that a toner image (developer image) is formed on the photosensitive drum 1. The developing device 8 includes a developing roller 4 as a developing member (developer carrying member), a developing container 5, and a developer application blade 7. Incidentally, the developing devices 8*a*, 8*b*, 8*c* and 8*d* of the image forming portions Sa, Sb, Sc and Sd accommodate the toners of yellow, magenta, cyan and black, respectively, in the associated developing containers 5. The developing roller 4 is connected to a developing voltage source 21. The toner accommodated in the developing device 8 is negatively charged by the developer application blade 7 and is applied onto the developing roller 4. Then, a predetermined developing voltage (developing bias) is applied from the developing voltage source 21 to the developing roller 4, so that the toner is deposited on an image portion of the electrostatic latent image at a developing portion where the developing roller 4 and the photosensitive drum 1 are in contact with each other. By this, on each of the photosensitive drums 1, the toner image corresponding to an image component of an associated color corresponding to the image forming portion S is formed. In this embodiment, on an exposure portion (image portion) of the photosensitive drum 1 where an absolute value of a potential is lowered through exposure to light after the uniform charging process, the toner charged to the same polarity (negative in this embodiment) as a charge polarity of the photosensitive drum 1 is deposited (reverse development). In this embodiment, a normal charge polarity of the toner which is the charge polarity of the toner during the development is the negative polarity.

An intermediary transfer belt 13 (belt for electrophotography) constituted by an endless belt as an intermediary transfer member is provided so as to oppose the four photosensitive drums 1*a* to 1*d*. The intermediary transfer belt 13 is extended around three stretching rollers consisting of a secondary transfer opposite roller (opposite roller) 15, a tension roller 14, and an auxiliary roller 19 which are stretching members and is stretched with predetermined tension. The tension roller 14 is urged by a spring (not shown) which is an urging member as an urging means so as to impart appropriate tension to the intermediary transfer belt 13. The opposite roller 15 also functioning as a driving roller is rotated (circulated and moved) in an arrow R2 direction (clockwise direction) in FIG. 1 by receiving a driving force from a driving source (not shown). The intermediary transfer belt 13 is rotated at the substantially same peripheral speed (process speed) relative to the photosensitive drums 1*a* to 1*d*. The stretching rollers other than the opposite roller 15 are rotated with movement of the intermediary transfer belt 13. The intermediary transfer belt 13 will be specifically described later.

In this embodiment, the opposite roller 15 is electrically grounded (connected to the ground). Incidentally, in this embodiment, the opposite roller 15 is an elastic roller constituted by coating a core metal formed of an aluminum material with a 0.5 mm-thick elastic layer formed of an EPDM rubber, and is 24.0 mm in outer diameter. Further, in this embodiment, as regards the opposite roller 15, carbon black is dispersed in the EPDM rubber so that an electric resistance value becomes about $1\times10^5\Omega$. The auxiliary roller 19 and the tension roller 14 which are other stretching rollers will be specifically described later.

On an inner peripheral surface side of the intermediary transfer belt 13, the primary transfer rollers 10*a*, 10*b*, 10*c* and 10*d* which are roller-shaped primary transfer members as primary transfer means are provided correspondingly to the photosensitive drums 1*a*, 1*b*, 1*c* and 1*d*, respectively. In this embodiment, each of the primary transfer rollers 10 is disposed at a position opposing the photosensitive drum 1 via the intermediary transfer belt 13 and contacts the inner peripheral surface of the intermediary transfer belt 13, and is rotated with movement of the intermediary transfer belt 13. The primary transfer roller 10 is urged toward the photosensitive drum 1 and is contacted to the photosensitive drum 1 via the intermediary transfer belt 13, and forms a primary transfer portion (primary transfer nip) N1 where the photosensitive drum 1 and the intermediary transfer belt 13 are in contact with each other. Further, the primary transfer roller 10 is connected to a primary transfer voltage source 22. Incidentally, in this embodiment, the primary transfer roller 10 is an elastic roller constituted by coating an elastic layer formed of a foamed elastic member so as to have an outer diameter of 14 mm around a core metal formed of a nickel-plated steel rod of 5 mm in outer diameter. Further, in this embodiment, as regards the primary transfer roller 10, an electroconductive agent is contained in a material of the elastic layer so as to adjust an electric resistance value at about $1\times10^6\Omega$. It is preferable that an electric resistance of the primary transfer roller 10 falls within a range of $10^3$ to $10^7\Omega$ from the viewpoint of carrying out good image formation.

The toner image formed on the photosensitive drum 1 is primary-transferred onto the intermediary transfer belt 13 as a rotating toner image receiving member by the action of the primary transfer roller 10 in the primary transfer nip N1. During the primary transfer, to the primary transfer roller 10, a primary transfer voltage (primary transfer bias) which is a DC voltage of a polarity (positive in this embodiment) opposite to the normal charge polarity of the toner is applied by a primary transfer voltage source 22. For example, during full-color image formation, toner images of yellow, magenta, cyan and black formed on the photosensitive drums 1*a*, 1*b*, 1*c* and 1*d*, respectively, are successively transferred superposedly onto the intermediary transfer belt 13. By this, on the intermediary transfer belt 13, a four color-based toner image corresponding to an objective color image is formed.

On an outer peripheral surface side, at a position opposing the opposite roller 15 via the intermediary transfer belt 13, a secondary transfer roller 25 which is a roller-shaped secondary transfer member as a secondary transfer means is provided. The secondary transfer roller 25 contacts an outer peripheral surface of the intermediary transfer belt 13 and is rotated with movement of the intermediary transfer belt 13. The secondary transfer roller 25 is urged toward the opposite roller 15 and is contacted to the opposite roller 15 via the intermediary transfer belt 13, and forms a secondary transfer portion (secondary transfer nip) N2 where the intermediary transfer belt 13 and the secondary transfer roller 25 are in contact with each other. Further, in this embodiment, the secondary transfer roller 25 is connected to a secondary transfer voltage source 26. Incidentally, in this embodiment, the secondary transfer roller 25 is an elastic roller constituted by coating an elastic layer formed of a foamed elastic member so as to have an outer diameter of 18 mm around a core metal of a nickel-plated steel rod of 6 mm in outer diameter. Further, in this embodiment, as regards the secondary transfer roller 25, an electroconductive agent is contained in a material of the electroconductive layer so as to adjust an electric resistance at about $1\times10^8\Omega$. It is preferable that the electric resistance of the secondary transfer roller 25 falls within a range of $10^7$ to $10^9\Omega$ from the viewpoint of carrying out good image formation.

The toner image formed on the intermediary transfer belt 13 is secondary-transferred onto a recording material P such as paper, an OHP sheet or the like as a toner image receiving member fed while being nipped between the intermediary transfer belt 13 and the secondary transfer roller 25 by the action of the secondary transfer roller 25 in the secondary transfer portion N2. During the secondary transfer, to the secondary transfer roller 25, a secondary transfer voltage (secondary transfer bias) which is a DC voltage of the polarity (positive in this embodiment) opposite to the normal charge polarity of the toner is applied by a secondary transfer voltage source 26. The recording materials P are accommodated in a cassette 16 as a recording material accommodating portion and is fed one by one from the cassette 16 by a feeding roller 17 as a feeding means and is fed (conveyed) toward a conveying roller pair 18 as conveying means. This recording material P is timed to the toner image on the intermediary transfer belt 13 and is conveyed by the conveying roller pair 18 toward the secondary transfer portion N2.

The recording material P on which the toner image is transferred is conveyed to a fixing device 50 as a fixing means. The fixing device 50 fixes (melts, sticks) the toner image on the recording material P by heating and pressing the recording material P on which the unfixed toner image is carried. For example, during the full-color image formation, the toners of the four colors are melted and mixed at that time and are fixed on the recording material P. Thereafter, the recording material P is discharged (outputted) and stacked on a discharge tray 52 as a stacking portion provided at an upper portion of an apparatus main assembly 110 of the image forming apparatus 100.

On the other hand, a deposited matter such as toner (transfer residual toner) remaining on the photosensitive drum 1 after the primary transfer is removed and collected from the surface of the photosensitive drum 1 by the drum cleaning device 3 as a photosensitive member cleaning means. The drum cleaning device 3 includes a cleaning blade as a cleaning member contacting the surface (outer peripheral surface) of the photosensitive drum 1 and a cleaning container for accommodating the deposited matter such as the toner removed from the surface of the photosensitive drum 1 by the cleaning blade. Further, on an outer peripheral surface side of the intermediary transfer belt 13, at a position opposing the opposite roller 15 via the intermediary transfer belt 13, a belt cleaning device 30 as an intermediary transfer member cleaning means is provided. A deposited matter such as the toner (secondary transfer residual toner) remaining on the intermediary transfer belt 13 after the secondary transfer is removed and collected from the surface of the intermediary transfer belt 13 by the belt cleaning device 30. The belt cleaning device 30 includes a cleaning blade 31 as a cleaning member contacting the surface (outer peripheral surface) of the intermediary transfer belt 13 at a position opposing the opposite roller 15. Further, the belt cleaning device 30 includes a cleaning container 32 for accommodating the deposited matter such as the toner removed from the surface of the intermediary transfer belt 13 by the cleaning blade 31. The belt cleaning device 30 will be specifically described later.

Incidentally, in each of the image forming portions S, the photosensitive drum 1, and as process means actable on the photosensitive drum 1, the charging roller 2, the developing device 8, and the drum cleaning device 3 integrally constitute a process cartridge mountable in and dismountable from the apparatus main assembly 110 of the image forming apparatus 100.

Further, the intermediary transfer belt 13, the respective stretching rollers 14, 15 and 19, the respective primary transfer rollers 10*a* to 10*d*, and the belt cleaning device 30 integrally constitute an intermediary transfer unit 23 mountable in and dismountable from the apparatus main assembly 110 of the image forming apparatus 100.

Further, the image forming apparatus 100 includes a control substrate (not shown) on which an electric circuit for controlling operations of the respective portions of the image forming apparatus 100 is mounted. On the control substrate, a CPU as a control means and a memory (not shown) or the like as a storing means in which various pieces of information are stored are mounted. The CPU carries out control relating to feeding of the recording material P, control relating to drive of the intermediary transfer belt 13 and a process cartridge 9, control relating to image formation, control relating to failure detection, and the like.

2. Belt Cleaning Device

Next, the belt cleaning device 30 as an intermediary transfer member cleaning means (belt cleaning means, collecting means) in this embodiment will be further described. Part (a) of FIG. 2 is a phantom sectional view for illustrating a mounting position of the cleaning blade 31 in the case where the cleaning blade 31 is not elastically deformed. Further, part (b) of FIG. 2 is a schematic sectional view for illustrating a structure of the belt cleaning device 30.

The belt cleaning device 30 includes a cleaning container 32 and a cleaning operating portion 33 provided in the cleaning container 32. The cleaning container 32 is constituted as a part of a frame (not shown) of the intermediary transfer unit 23 including the intermediary transfer belt 13 and the like. The cleaning operating portion 33 includes the cleaning blade 31 as a cleaning member (contact member) and a supporting member 34 for supporting the cleaning blade 31. The cleaning blade 31 is an elastic blade constituted by using an urethane rubber (polyurethane) which is an elastic material (elastic member). The cleaning blade 31 is fixed, by bonding, to the supporting member 34 formed of a plated steel plate as a material. The cleaning blade 31 is fixed to the cleaning container 32 via the supporting member 34.

The cleaning blade 31 is an elongated plate-like member in a widthwise direction of the intermediary transfer belt 13 substantially perpendicular to the movement direction of the intermediary transfer belt 13. That is, the cleaning blade 31 is the plate-like member having a predetermined length with respect to each of a longitudinal direction substantially parallel to a widthwise direction of the intermediary transfer belt 13 and a short (side) direction substantially perpendicular to the longitudinal direction and having a predetermined thickness. As regards the cleaning blade 31, a free end portion 31*e* thereof which is one end portion with respect to the short direction is contacted to the surface (outer peripheral surface) of the intermediary transfer belt 13, and a part of a fixed end portion 31*f* which is the other end portion with respect to the short direction is fixed to the supporting member 34 by bonding. In this embodiment, a length of the cleaning blade 31 with respect to the longitudinal direction is 230 mm, a thickness of the cleaning blade 31 is 2 mm, and hardness of the cleaning blade 31 is 77 degrees in terms of JIS K 6253.

The cleaning operating portion 33 is constituted so as to be swingable relative to the surface of the intermediary transfer belt 13. That is, the supporting member 34 is supported by the cleaning container 32 so as to be swingable relative to the surface of the intermediary transfer belt 13 about a swing shaft 35. The supporting member 34 is pressed by a pressing spring 36 which is an urging member as an urging means provided in the cleaning container 32. By this, the cleaning operating portion 33 is rotated (swung) about the swing shaft 35, so that the cleaning blade 31 is urged (pressed) against the surface of the intermediary transfer belt 13.

On the inner peripheral surface side of the intermediary transfer belt 13, the opposite roller 15 is disposed opposed to the cleaning blade 31. The cleaning blade 31 is contacted to the surface of the intermediary transfer belt 13 so as to extend in a counter direction to the movement direction at a position opposing the opposite roller 15. That is, the cleaning blade 31 is contacted to the surface of the intermediary transfer belt 13 so that the free end portion 31*e* faces an upstream side of the movement direction of the intermediary transfer belt 13. By this, as shown in part (b) of FIG. 2, a blade nip 37 which is a contact portion between the cleaning blade 31 and the intermediary transfer belt 13 is formed. In the blade nip 37, the cleaning blade 31 scrapes off the deposited matter such as the secondary transfer residual toner from the surface of the moving intermediary transfer belt 13, and collects the deposited matter into the cleaning container 32.

As shown in part (a) of FIG. 2, an angle formed by a tangential line of the opposite roller 15 at a point of intersection of the intermediary transfer belt 13 and the cleaning blade 31 and by a surface of the cleaning blade 31 is referred to as a setting angle (set angle) θ. Further, as shown in part (a) of FIG. 2, a distance from the tangential line of the opposite roller 15 at the point of intersection of the intermediary transfer belt 13 and the cleaning blade 31 to a tip (edge on the opposite roller 15 side) of the free end portion 31*e* of the cleaning blade 31 is referred to as a penetration amount (entering amount) δ. The setting angle θ and the penetration amount δ are optimized so as to achieve a good cleaning performance.

3. Intermediary Transfer Belt

Next, the intermediary transfer belt 13 in this embodiment will be further described.

Part (a) of FIG. 3 is a schematic perspective view of an outer appearance of the intermediary transfer belt 13. Further, part (b) of FIG. 3 is a schematic sectional view of an enlarged portion of the intermediary transfer belt 13 but (viewed along a movement direction R3 of the intermediary transfer belt 13) in a direction substantially perpendicular to the movement direction R3 of the intermediary transfer belt 13.

In this embodiment, the intermediary transfer belt 13 is an endless belt member (or a film-like member) consisting of three layers of a base layer 41, a surface layer 40, and an electroconductive layer 42. In this embodiment, a peripheral length of the intermediary transfer belt 13 is 700 mm.

Here, the base layer 41 of the intermediary transfer belt 13 is defined as a thickest layer of the layers constituting the intermediary transfer belt 13 with respect to a thickness direction of the intermediary transfer belt 13. In this embodiment, the base layer 41 is formed by dispersing a quaternary ammonium salt which is an ion-conductive agent as an electric resistance adjusting agent into a polyethylene naphthalate resin which is a polyester resin as a base material. In this embodiment, a thickness of the base layer 41 is 70 μm.

Further, the surface layer 40 is formed on the base layer 41 on the outer peripheral surface side of the intermediary transfer belt 13. In this embodiment, the surface layer 40 is formed by dispersing antimony-doped zinc oxide as the electric resistance adjusting agent into an acrylic resin as a base material and by adding polytetrafluoroethylene (PTFE) particles as a solid lubricant in a resultant dispersion. In this embodiment, a thickness of the surface layer 40 is 3 82 m. The surface layer 40 will be further specifically described later. Further, the electroconductive layer 42 is formed on the base layer 41 on the inner peripheral surface side of the intermediary transfer belt 13. In this embodiment, the electroconductive layer 42 is formed by mixing carbon black as an electroconductive agent into a polyester resin as a base material so as to have a low resistance. In this embodiment, a thickness of the electroconductive layer 42 is 3 μm. The electroconductive layer will be further specifically described later.

The surface layer 40 will be further described. As the base material of the surface layer 40, from the viewpoints of strength such as an anti-wearing property and an anti-cracking property, of curable materials, a resin material (curable resin) is preferred, and of the curable resin materials, an acrylic resin material is preferred. In this embodiment, the surface layer 40 was obtained by applying, onto a surface of the base layer 41, a liquid containing at least one of an ultraviolet-curable monomer component or an ultraviolet-curable oligomer component and then by irradiating the liquid with energy ray such as ultraviolet radiation (ray), thus curing a resultant liquid.

An outline of an example of a preparation method of the surface layer 40 is as follows. The antimony-doped zinc oxide as an electroconductive material and the PTFE particles as the solid lubricant are mixed in an acrylic copolymer containing unsaturated double bonds and then are dispersed and mixed by a high-pressure emulsion dispersing machine, so that a coating liquid for forming the surface layer 40 is prepared. As a coating method of forming the surface layer 40 on the base layer 41, it is possible to cite ordinary coating methods, such as dip coating, spray coating, roll coating, and spin coating. The coating method is appropriately selected from these coating methods and is appropriately used, so that the surface layer 40 having a desired thickness can be obtained.

Next, the electroconductive layer 42 of the intermediary transfer belt 13 will be further described. The electroconductive layer 42 is a layer formed on the inner peripheral surface side of the intermediary transfer belt 13. That is, with respect to the thickness direction of the intermediary transfer belt 13, the base layer 41 is disposed at a position closer to the photosensitive drums la to ld than the electroconductive layer 42 is. In this embodiment, the electroconductive layer 42 was formed by subjecting the base layer 41 to the spray coating. A method of forming the electroconductive layer 42 will be further described later specifically.

In this embodiment, an electric resistance is different between the base layer 41 and the electroconductive layer 42, and the electric resistance of the electroconductive layer 42 is set so as to lower than the electric resistance of the base layer 41.

Volume resistivity and surface resistivity of the intermediary transfer belt 13 were measured in a measurement environment of a temperature of 23° C. and a relative humidity of 50% RH by using a resistivity meter ("Hiresta-UP (MCP-HT450)", manufactured by Mitsubishi Chemical Corp.). As regards measurement of the volume resistivity, a ring probe (type: UR (model: MCP-HTP12) was used and was pressed against the intermediary transfer belt 13 from the outer peripheral surface side, and a measurement condition was an applied voltage of 100 V and a measurement time of 10 sec. The measurement of the surface resistivity was made by using a ring probe (type: UR-100 (model: MCP-HTP16) under a condition of an applied voltage of 10 V and a measurement time of 10 sec. The surface resistivity of the intermediary transfer belt 13 on the inner peripheral surface was measured by pressing the probe against the electroconductive layer 42 side, and the surface resistivity of the intermediary transfer belt 13 on the outer peripheral surface side was measured by pressing the probe against the surface layer 40 side. In this embodiment, the surface resistivity of the intermediary transfer belt 13 on the inner peripheral surface side and the surface resistivity of the intermediary transfer belt 13 on the inner peripheral surface side are defined as an electric resistance of the electroconductive layer 42 and an electric resistance of the surface layer 40, respectively. Incidentally, in the case where the surface resistivity of the base layer 41 is measured in the intermediary transfer belt 13 having the three-layer structure, the measurement was made after abrading the surface layer 40 or after the surface layer 40 is peeled off of the base layer 41.

In this embodiment, the surface resistivity of the intermediary transfer belt 13 measured from the outer peripheral surface side (surface layer 40 side) reflects the electric resistance of the surface layer 40, and was $2.6\times10^{11}\Omega/\square$ in this embodiment. Further, in this embodiment, the surface resistivity of the intermediary transfer belt 13 measured from the inner peripheral surface side (electroconductive layer 42 side) reflects the electric resistance of the electroconductive layer 42, and was $4.7\times10^{6}\Omega/\square$. Further, in this embodiment, when the surface resistivity of the base layer 41 was measured by the method as described above, the surface resistivity of the base layer 41 was $3.2\times10^{9}\Omega/\square$. Thus, in this embodiment, when the electric resistances of the respective layers are compared with each other, the electric resistance of the electroconductive layer 42 is set at a lowest value.

In this embodiment, the intermediary transfer belt 13 of which volume resistivity falls within a range of $1\times10^{9}\Omega$.cm or more and $1\times10^{10}\Omega$.cm or less, and of which surface resistivity on the inner peripheral surface side is lower than the surface resistivity on the outer peripheral surface side and falls within a range of $5.0\times10^{6}\Omega/\square$ or less was used. Incidentally, the surface resistivity of the intermediary transfer belt 13 on the inner peripheral surface side (electroconductive layer 42) is typically $1.0\times10^{4}\Omega/\square$ or more for manufacturing reason or the like. With a larger thickness of the electroconductive layer 42, the surface resistivity of the intermediary transfer belt 13 on the inner peripheral surface side can be made lower. However, when the thickness of the intermediary transfer belt 13 is excessively large, there is a liability that a crack of the electroconductive layer 42 due to bending of the intermediary transfer belt 13 and peeling-off of the base layer of the electroconductive layer 42. In view of these, in this embodiment, the thickness of the electroconductive layer 42 is set at 3 μm.

A manufacturing method of the electroconductive layer 42 will be described. The electroconductive layer 42 contains electroconductive particles as an electroconductive agent and a binder resin.

As the electroconductive particles contained in the electroconductive layer 42, electroconductive agent can be used. For example, as the electron-conductive agent, it is possible to cite carbon black, graphite, carbon nanotube ("CNT"), carbon micro coil, graphene, zinc oxide, zinc antimonate, and the like. As the electron-conductive agent, it is also possible to cite tin oxide, ITO (indium tin oxide), ATO (antimony-doped tin oxide), and the like. Further, as the electron-conductive agent, it is further possible to cite electroconductive polymers such as polyamine, polypyrrole, polythiophene, and the like. Of these materials, high-electroconductive carbon black such as ketjenblack (registered trademark) is preferred. A content of the carbon black in the electroconductive layer 42 may preferably be 6 wt. % or more from the viewpoint of the above-described surface resistivity. Further, from the viewpoint of physical deteriorations such as a crack and abrasion due to friction (slide) with other slidable members (such as a transfer roller, a stretching roller, and the like), the content of the carbon black in the electroconductive layer 42 may preferably be 15 wt. % or less. That is, the content of the carbon black in the electroconductive layer 42 may preferably be 6 wt. % or more and 15 wt. % or less, more preferably be 9 wt. % or more and 13 wt. % or less.

Here, the content of the carbon black in the electroconductive layer 42 can be acquired from analysis of a composition of a solid matter collected by filtering, through a membrane filter, a solution obtained by dissolving the electroconductive layer 42 in a solvent. Further, the content of the carbon black in the electroconductive layer 42 may also be calculated from an addition amount of the carbon black when the electroconductive layer 42 is formed.

The electroconductive layer 42 contains a dispersing agent for the electroconductive particles. As the dispersing agent for the carbon black as an example of the electroconductive particles, it is possible to cite an anionic surfactant, a non-ionic surfactant, a transition metal complex, and the like. Of these materials, the dispersing agent consisting of the transition metal complex having an aromatic functional group has high absorptive property to a surface of the carbon black by π-π electron interaction and thus exhibits an excellent dispersing property, and therefore, this dispersing agent is preferred from the view point of uniformity of the electric resistance of the electroconductive layer 42. As the dispersing agent consisting of the transition metal complex having the aromatic functional group, it is possible to cite a zinc compound, a cobalt compound, a copper compound, and the like which have a porphyrin structure or a phthalocyanine structure. Of these material, the copper compound having the aromatic functional group is preferred for the reason such that this copper compound is inexpensive and is high in dispersive power. Incidentally, "MHI black #273" (trade name, manufactured by Mikuni-Color Ltd.) contains, as the dispersing agent for the carbon black, the dispersing agent consisting of the copper compound having the aromatic functional group.

The content of the copper compound in the electroconductive layer 42 may preferably be 1.0 wt. % or more from the viewpoint of the dispersing property of the carbon black. Further, from the viewpoint of suppressing a lowering in mechanical characteristic of a film (electroconductive layer 42) with a lowering in ratio of the binder resin relative to an increase in amount of the dispersing agent in the electroconductive layer 42, the content of the copper compound may preferably be 13.5% or less. That is, the content of the copper compound in the electroconductive layer 42 may preferable be in a range of 1.0 wt. % or more and 13.5 wt. % or less, more preferably be in a range of 2.0 wt. % or more and 8.0 wt. % or less.

Here, the content of the copper compound in the electroconductive layer 42 can be acquired from a weight of a solid matter obtained by warming, in an oven or the like, a filtrate collected by subjecting a solution obtained by dissolving the electroconductive layer 42 in a solvent for filter the carbon black through a membrane filter and thus by removing the solvent from the filtrate. Further, the content of the copper compound in the electroconductive layer 42 may also be calculated from an addition amount of the copper compound when the electroconductive layer 42 is formed.

Further, an amount of the copper in the copper compound can be acquired from an amount of a residue after the copper compound is subjected to thermal composition reaction. In the materials constituting the copper compound, the copper is highest in thermal composition temperature. For that reason, the solid matter obtained from the above-described filtrate is subjected to heat treatment at a temperature of not less than a decomposition temperature of an organic compound and less than a decomposition temperature of the copper in an air environment by using a thermogravimetric analyzer (TGA), so that the thermal decomposition reaction is caused to proceed. By this, the content of the copper can be calculated. As a specific condition, the temperature is increased up to 600° C. at a rate of temperature rise of 20° C./min., and thereafter, the copper compound is maintained for several hours, so that the thermal decomposition reaction of the material other than the copper is caused to proceed. It is possible to discriminate that the thermal decomposition reaction is completed by a weight-decreasing rate of 1%/hour or less. The copper is contained in the above-described copper compound by about 1 wt. %. For this reason, for example, when the range of 2.0 wt. % or more and 8.0 wt. % or less, which is the suitable content of the copper compound in the above-described electroconductive layer 42 is converted into the content of the copper in the electroconductive layer 42, the range corresponds to a range of 0.02 wt. % or more and 0.08 wt. % or less.

As the binder resin used in the electroconductive layer 42, a polyester resin (material) having a monomer unit derived from at least two phthalic acids selected from the group consisting of terephthalic acid, orthophthalic acid, and isophthalic acid. For example, this polyester is a copolymer including an ethylene terephthalate unit and an ethylene ortho-phthalate unit, a copolymer including the ethylene terephthalate unit and an ethylene isophthalate unit. Further, as another example, the polyester is a copolymer including the ethylene ortho-phthalate unit and the ethylene isophthalate unit. These copolymers may also be any one of random and block copolymers. Further, these copolymers may also be used as a mixture of two or more species of copolymers which are blended or alloyed. In this case, the resultant electroconductive layer 42 is very high in amorphousness since a plurality of polyesters different in chemical structure are present in mixture. The chemical structure of the above-described polyester resin can be identified by using thermal decomposition GC/MS, IR, NMR, elementary analysis, or the like through extraction of polyester from the electroconductive layer 42 by an appropriate means such as dissolution with a solvent and then through isolation.

The electroconductive layer 42 may also contain, in addition to the above-described binder resin, another addition without impairing an effect of the present invention described later. Specifically, it is possible to cite the following additive. The additive includes molybdenum disulfide, boron nitride, silicon nitride, laminar clay mineral, silicone particles, fluorine-containing resin particles, silicone oil, fluorine-containing oil, perfluoropolyether, a crystal control agent, a cross-linking agent, and the like. The above-described additives contained in the electroconductive layer 42 may be used singly or may also be used in combination of two or more species. Of these materials, a copolymer (polyester-urethane resin) of polyester and urethane is formed by adding the cross-linking agent such as isocyanate to raw materials of the polyester resin, from the viewpoint of improving hardness of the electroconductive layer 42.

The polyester resin of the electroconductive layer 42 is preferable that the polyester resin can be applied in the form of a solution thereof in a solvent in view of a thickness of the electroconductive layer 42. For example, a method of forming the electroconductive layer 42 include a step of forming the electroconductive layer 42 by applying, onto the base layer 41, paint for forming the electroconductive layer 42 containing the polyester resin, a solvent for dissolving the polyester resin, carbon black, and the dispersing agent. The polyester resin can be used by subjecting raw materials of dicarboxylic acid, diol, and the like to ester exchange reaction and polycondensation or by using a commercially available polyester resin-containing paint. The carbon black and the dispersing agent can be each mixed in an associated solvent and then can be dispersed in the polyester resin by a bead mill or the like, or commercially available slurry in which the carbon black, the dispersing agent, and the solvent are dispersed uniformly with the polyester resin in advance can be used. Specifically, "MIR black #273" (trade name, manufactured by Mikuni-Color Co., Ltd.) or the like can be used. As the solvent, specifically, methyl ethyl ketone, methyl, isobutyl ketone, cyclohexanone, or the like can be used. Further, in the point for forming the electroconductive layer 42, it is possible to add an additive such as a leveling agent as desired. As the leveling agent, a well-known one can be appropriately selected and used. The resultant point for forming the electroconductive layer 42 is applied onto an inner peripheral surface of the base layer 41 shaped in the endless belt by an applying means such as dip coating, spray coating, ring coating or roll coating. Thereafter, the solvent is removed by drying, so that the electroconductive layer 42 as a paint (coating) layer can be formed.

By the method as described above, the intermediary transfer belt 13 including the electroconductive layer 42 forming the inner peripheral surface can be formed.

Incidentally, the structure of the intermediary transfer belt 13 is not limited to the three-layer structure, but may also be, for example, a two-layer structure of the base layer 41 and the electroconductive layer 42 or a structure of four or more layers in which another layer is provided between the base layer 41 and the surface layer 40 or between the base layer 41 and the electroconductive layer 42. Further, as a base material of the base layer 41 other than the polyester resin, a material such as polyvinylidene fluoride (PVdF) or acrylonitrile-butadiene-styrene (ABS) copolymer or a mixture resin of these may also be used. Further, as the binder resin of the electroconductive layer 42, another material such as acrylic resin or the like may also be used. However, for the reason that a belt having a desired electric characteristic is easily obtained or for the like reason, the base material of the base layer 41 may preferably contain the polyester resin. Further, for the above-described reason, the binder resin of the electroconductive layer 42 may preferably contain the polyester resin as described above.

4. Stretching Rollers

Next, the stretching rollers for the intermediary transfer belt 13 in this embodiment will be described.

The image forming apparatus 100 of this embodiment includes, as the stretching rollers for the intermediary transfer belt 13, the opposite roller 15, the tension roller 14, and the auxiliary roller 19.

In this embodiment, as described above, the opposite roller 15 is the elastic roller constituted by coating the elastic layer, on the core metal formed of aluminum, formed of the EPDM rubber in the thickness of 0.5 mm, and is 24.0 mm in outer diameter.

Further, in this embodiment, the tension roller 14 and the auxiliary roller 19 are metal rollers each in which a roller portion (a cylindrical or circular column portion contactable to the intermediary transfer belt 13) around which the intermediary transfer belt 13 is wound is formed of metal. In this embodiment, each of the tension roller 14 and the auxiliary roller 19 is the metal roller which include the roller portion and rotational shaft portions provided at opposite end portions of the roller portion with respect to a rotational axis direction and rotatably supported by bearings, and which is formed of metal at an entire area thereof. Incidentally, the roller portion of the metal roller may also be a solid portion or a hollow portion, but in this embodiment, the metal roller constituting each of the tension roller 14 and the auxiliary roller 19 is a hollow roller at an entire portion including the roller portion. In this embodiment, the tension roller 14 includes the roller portion which has an outer diameter of 20.0 mm and which has a length, with respect to the rotational axis direction, of 250 mm equal to the width of the intermediary transfer belt 13. In this embodiment, the auxiliary roller 19 includes the roller portion which has an outer diameter of 18 mm and which has a length, with respect to the rotational axis direction, of 260 mm. Incidentally, in this embodiment, a shape of the roller portion of the tension roller 14 is a straight shape such that the outer diameter thereof in its entire area with respect to the rotational axis direction. On the other hand, a shape of the roller portion of the auxiliary roller 19 may also be similar straight shape, but may preferably be a tapered shape for the purpose of improving image quality by preventing waving of the intermediary transfer belt 13 between the auxiliary roller 19. In this embodiment, this tapered shape is such that the outer diameter of the auxiliary roller 19 at each of the opposite end portions with respect to the rotational axis direction of the roller portion of the auxiliary roller 19 is smaller than the outer diameter of the auxiliary roller 19 at a central portion with respect to the rotational axis direction (crown shape).

Particularly, in this embodiment, the tension roller 14 and the auxiliary roller 19 are formed of an aluminum material which is a metal material which is relatively inexpensive and which is relatively easily processed. Incidentally, herein, the "aluminum phthalic acid" is an aluminum-based metal material including aluminum (pure aluminum) and an aluminum alloy. The aluminum alloy is an alloy principally comprising aluminum (a content of aluminum is largest). Further, herein, the metal roller formed of the aluminum material as the metal material is also referred to as an "aluminum roller". In this embodiment, the aluminum roller constituting the tension roller 14 and the auxiliary roller 19 is formed using an aluminum alloy of A6063 in alloy number.

Further, in this embodiment, each of the tension roller 14 and the auxiliary roller 19 includes an alumite layer forming a surface of the roller portion thereof contacting the inner peripheral surface (electroconductive layer 42) of the intermediary transfer belt 13. Here, an oxide film formed by subjecting the aluminum material to alumite treatment (anodic oxidation) is referred to as the "alumite layer". That is, in this embodiment, the surface of each of the tension roller 14 and the auxiliary roller 19 which are constituted by aluminum rollers and which contact the electroconductive layer 42 of the intermediary transfer belt 13 is subjected to the alumite treatment (anodization). By this, at the roller portion of each of the tension roller 14 and the auxiliary roller 19, the alumite layer forming the surface contacting the electroconductive layer 42 of the intermediary transfer belt 13 is provided. Part (a) of FIG. 5 is a schematic sectional view (cross section substantially perpendicular to the rotational axis direction) showing a layer structure of a roller portion 60 of the tension roller 14 (auxiliary roller 19) in this embodiment. In this embodiment, the roller portion 60 of the tension roller 14 (auxiliary roller 19) includes an alumite layer 62 forming a surface of a base material 61 formed of aluminum. In this embodiment, the roller portion 60 of the tension roller 14 (auxiliary roller 19) is provided with the alumite layer 62 on a surface of a full circumference of at least a portion (entire area with respect to the rotational axis direction in this embodiment) contacting the inner peripheral surface of the intermediary transfer belt 13.

The alumite treatment can be performed by using an available known method. The alumite treatment is a method in which the surface of the aluminum material is electrochemically oxidized by using an electrolytic solution such as sulfonic acid or oxalic acid and thus a film of aluminum oxide ($Al_2O_3$, alumina) is formed. Further, the alumite layer may also be subjected to pore sealing by using an available known method. As the pore sealing of the alumite layer, for example, it is possible to use steam treatment, boiling water treatment, or the like.

Incidentally, in this embodiment, the tension roller 14 and the auxiliary roller 19 have a similar constitution with respect to the surface alumite layer.

The thickness of the alumite layer may also be 5 μm or more in some cases, but may preferably be 10 μm or more for the purpose of coating the surface of the aluminum roller with the alumite layer with reliability. Further, the thickness of the alumite layer is 50 μm or less for the reason of manufacturing or the like, and is typically 30 μm or less since the thickness is necessary and sufficient. In this embodiment, the thickness of the alumite layer was 15 μm.

The thickness of the alumite layer can be measured by a measuring method of an eddy current type in which a thickness meter "DUALSCOPE EP0R" is used as a measuring device. A measurement principle is as follows. That is, when an AC magnetic field by a high-frequency alternating current is generated at a coil portion in a measuring probe, an eddy current generates a direction of cancelling the magnetic field. There is a correlation between a magnitude of a resistance generated by the cancelling of the magnetic field by the eddy current and a probe distance (film thickness), and therefore, the resistance can be converted into the film thickness. For that reason, the above-described measuring device is effective in measuring insulation coating on non-magnetic metal. In this embodiment, the thickness of the alumite layer of each of the tension roller 14 and the auxiliary roller 19 was measured at six points in total (three points, with respect to the rotational axis direction, at each of two portions which are two equal parts into which the roller portion is divided along a circumferential direction) on the roller portion. The thickness of the alumite layer can be represented by an average of values measured at a plurality of positions, which are sufficient numbers, of the surface of the alumite layer contacting the electroconductive layer 42 of the above-described intermediary transfer belt 13.

Further, hardness of the alumite layer may preferably be 100 HV or more in terms of Vickers hardness in order to prevent abrasion of the alumite layer by friction (slide) between the alumite layer and the intermediary transfer belt 13. In the case here the hardness of the alumite layer is less than 100 HV in terms of the Vickers hardness, the surface of the tension roller 14 or the auxiliary roller 19 is scarred by the friction between the alumite layer and the intermediary transfer belt 13, and there is a possibility that the scars cause damage to the electroconductive layer 42 of the intermediary transfer belt 13. From the above-described viewpoint, the hardness of the alumite layer may more preferably be 120 HV or more in terms of the Vickers hardness. Further, the hardness of the alumite layer is 400 HV or less in terms of the Vickers hardness for the reason of manufacturing or the like reason, and is typically 250 HV or less since the hardness is necessary and sufficient.

The hardness of the alumite layer can be measured by using a commercially available Vickers hardness tester (for example, "Vickers hardness tester NMT-X7", manufactured by Matsuzawa Co., Ltd.).

5. Effect

Next, an effect by the constitution of this embodiment will be described. In this embodiment, as described above, the tension roller 14 and the auxiliary roller 19 have the similar constitution as regards the surface alumite layer, and therefore, the tension roller 14 will be described as an example.

In the case where a high-temperature storage evaluation on the assumption that the intermediary transfer belt 13 stretched by the tension roller 14 constituted by the aluminum roller provided with no alumite layer at a surface thereof is left standing or transported in a high-temperature/high-humidity to environment was carried out, it turned out that the following phenomenon occurs.

By using FIG. 4, a phenomenon possibly occurring during the above-described high-temperature storage will be described. Part (a) of FIG. 4 is a schematic view showing a contact portion between the tension roller 14 constituted by the aluminum roller provided with no alumite layer at the surface thereof and the electroconductive layer 42 of the intermediary transfer belt 13. Further, parts (b) to (e) of FIG. 4 are schematic enlarged views of the contact portion. Incidentally, as described above, in this embodiment, the case of the tension roller 14 will be described, but the case of the auxiliary roller 19 is also similar to the case of the tension roller 14.

First, a copper ion generates from the copper compound contained as the dispersing agent in the electroconductive layer 42 of the intermediary transfer belt 13. Then, oxidation-reduction reaction occurs between the generated copper ion and aluminum of the tension roller 14. By this, as shown in part (b) of FIG. 4, an electric charge moves from the aluminum toward the copper ion, so that an aluminum ion generates as shown in part (c) of FIG. 4. Further, as shown in part (d) of FIG. 4, the generated aluminum ion is oxidized at the surface of the tension roller 14 and is deposited as an oxide on the surface of the tension roller 14.

This phenomenon is liable to occur particularly in the high-temperature/high-humidity environment (condition) in which a relatively large water content is contained in the air. In the image forming apparatus 100, there is a possibility that an amount of water content contained in the air in the image forming apparatus 100 when the image forming apparatus 100 is left standing or transported becomes large. Further, in the image forming apparatus 100, heat is applied by the fixing device 50, whereby the water content contained in the recording material P is vaporized, so that the amount of the water content contained in the air inside the image forming apparatus 100 becomes large. Further, in some cases, there is a possibility that dew condensation occurs inside the image forming apparatus 100. Thus, in the case where the water content contained in the air inside the image forming apparatus 100 is large, reaction is liable to generate between the electroconductive layer 42 of the intermediary transfer belt 13 and the tension roller 14 as described above.

As regards component ($Al_2O_3$, $Al(OH)_3$, and the like) generated by the above-described oxidation-reduction reaction and derived from the aluminum, there is a possibility that these components adhere to the surface (interface between the intermediary transfer belt 13 and the tension roller 14) of the tension roller 14. When this adherence occurs, there is a possibility that sticking occurs between the intermediary transfer belt 13 and the tension roller 14. Further, in the case where this sticking occurs, when rotation of the intermediary transfer belt 13 starts during actuation of the image forming apparatus 100, the intermediary transfer belt 13 is not readily separated from the tension roller 14. For that reason, there is a possibility that the intermediary transfer belt 13 winds around the tension roller 14 and causes folding. Further, when the rotation of the intermediary transfer belt 13 is continued, a force is applied to a portion where the above-described sticking occurs, and therefore, the intermediary transfer belt 13 is separated from the tension roller 14, but at this time, there is a possibility that as shown in part (e) of FIG. 4, the intermediary transfer belt 13 is peeled off of the tension roller 14 together with the electroconductive layer 42. When this peeling-off of the electroconductive layer 42 occurs, the base layer 41 exposes to the surface of the intermediary transfer belt 13, so that a portion where there is no electroconductive layer 42 is formed.

When deformations such as the folding of the intermediary transfer belt 13 and the peeling-off of the electroconductive layer 42 occur as described above, there is no problem if degrees of the occurrences thereof are slight, but in the case where degrees of the deformations and advanced due to repetitive occurrences or the like, there is a possibility that improvement in durability of the image forming apparatus 100 becomes difficult.

First, when the folding of the intermediary transfer belt 13 occurs, a shape of the intermediary transfer belt 13 becomes a recessed shape at the folded portion. By this, a space is formed between the photosensitive drum 1 and the intermediary transfer belt 13 during the primary transfer, so that there is a possibility that the primary transfer cannot be carried out and thus image defect occurs. Similarly, also during the secondary transfer, a space is formed between the intermediary transfer belt 13 and the recording material P, so that there is a possibility that the secondary transfer cannot carried out and thus the image defect occurs. Further, when the deposited matter such as the secondary transfer residual toner is collected, followability of the cleaning blade 31 to the above-described recessed shape of the cleaning blade 31 becomes insufficient, so that there is a possibility that the deposited matter such as the secondary transfer residual toner is not completely collected. Or, reversely, the shape of the cleaning blade 31 follow the recessed shape, so that there is a possibility that a contact state between the cleaning blade 31 and the intermediary transfer belt 13 changes and thus the deposited matter such as the secondary transfer residual toner passes through the cleaning blade 31. Thus, when a degree of an occurrence of the folding of the intermediary transfer belt 13 is advanced, there is a possibility that the image defect or the like occurs, and therefore, there arises a need to exchange the intermediary transfer belt 13 or the like, so that there is a possibility that improvement in durability of the image forming apparatus 100 becomes difficult.

Further, when the peeling-off (peeled-out portion) of the electroconductive layer 42 occurs in the intermediary transfer belt 13, by the friction of the electroconductive layer 42 with another slidable member (for example, the transfer roller, the stretching roller, and the like), there is a possibility that a peeling-off region of the electroconductive layer 42 is enlarged from the previously peeling-off portion as a starting point. Further, when the peeling-off of the electroconductive layer 42 of the intermediary transfer belt 13 occurs, by the friction of the electroconductive layer 42 with another slidable member (for example, the transfer roller, the stretching roller, and the like), there is a possibility that the base layer 41 inside the peeled electroconductive layer 42 is damaged by the friction. The portion where the electroconductive layer 42 is peeled out is higher in electric resistance than the original intermediary transfer belt 13, so that there is a possibility that transfer voltages necessary during the primary transfer end during the secondary transfer become insufficient and thus the image defect occurs. Further, when the base layer 41 of the intermediary transfer belt 13 is damaged, there is a liability that mechanical strength of the intermediary transfer belt 13 lowers. Thus, when a degree of the peeling-off of the electroconductive layer 42 of the intermediary transfer belt 13 is advanced, there is a possibility that the image defect or the like occurs, and therefore, there arises a need to exchange the intermediary transfer belt 13 or the like, so that there is a possibility that improvement in durability of the image forming apparatus 100 becomes difficult.

As described above, a good transfer performance can be achieved by using the intermediary transfer belt 13 including the low-resistant electroconductive layer 42 forming the inner peripheral surface of the intermediary transfer belt 13. However, in the high-temperature/high-humidity environment, there is a possibility that a component generating by reaction between the aluminum of the aluminum roller contacting the electroconductive layer 42 and the copper of the copper compound contained as the dispersing agent in the electroconductive layer 42 adheres to the surface of the aluminum roller. Further, by this adherence component, there is a possibility that the sticking occurs between the intermediary transfer belt 13 and the aluminum roller. As a result, the folding of the intermediary transfer belt 13 and the peeling-off of the electroconductive layer 42 occur, so that there is a possibility that improvement in durability of the image forming apparatus 100 becomes difficult.

The cause of the above-described problem is in that the oxidation-reduction reaction occurs between the copper of the copper compound contained in the electroconductive layer 42 and the aluminum of the aluminum roller. Therefore, in this embodiment, in order to suppress this, the surface of the tension roller 14 (and further the auxiliary roller 19 in this embodiment) constituted by the aluminum roller is subjected to the alumite treatment, so that the alumite layer (oxide film) is formed at the surface. The aluminum roller of which surface is subjected to the alumite treatment is used as the tension roller 14 (and further the auxiliary roller 19 in this embodiment), so that the aluminum of the aluminum roller and the electroconductive layer 42 do not directly contact each other, and the alumite layer of the aluminum roller and the electroconductive layer 42 contact each other. For that reason, the above-described oxidation-reduction reaction is suppressed, so that the occurrence of the above-described problem due to the sticking between the intermediary transfer belt 13 and the aluminum roller can be suppressed. In this embodiment, the thickness of the alumite layer was set at 15 μm as a thickness enough to suppress the above-described reaction and to insulate the intermediary transfer belt 13 and the tension roller 14.

Here, when the alumite layer is provided on the tension roller 14 constituted by the aluminum roller, the tension roller 14 becomes an insulating roller, so that it would be considered that a charge-up phenomenon of the surface of the tension roller 14 formed by the alumite layer can occur. However, the electroconductive layer 42 forming the inner peripheral surface of the intermediary transfer belt 13 is low in resistance, and therefore, an energization path from the surface of the tension roller 14 to the opposite roller 15 or the primary transfer roller 10. Therefore, the charge-up phenomenon does not occur. This is also true for the auxiliary roller 19.

Thus, the image forming apparatus 100 of this embodiment includes the intermediary transfer belt 13 which has the endless belt shape and which includes the base layer 41 and the electroconductive layer 42 positioned on the inner peripheral surface side than the base layer 41 is and forming the inner peripheral surface of the intermediary transfer belt 13. The electroconductive layer 42 contains the binder resin, the electroconductive particles as the electroconductive agent which is the carbon black in this embodiment, and the copper compound used as the dispersing agent for the electroconductive particles in this embodiment. Further, the surface resistivity of the electroconductive layer 42 is $50\times10^6\Omega/\square$ or less. In this embodiment, the base layer 41 contains the polyester resin. Further, in this embodiment, the binder resin contains the polyester resin including the monomer unit derived from at least two phthalic acids selected from the group consisting of the terephthalic acid, the ortho-phthalic acid, and the isophthalic acid. Further, the image forming apparatus 100 includes the rollers (the tension roller 14 and the auxiliary roller 19) each of which is disposed on the inner peripheral surface side of the intermediary transfer belt 13, which is formed of the aluminum material at its roller portion around which the intermediary transfer belt 13 is wound, and which includes the alumite layer 62 forming the surface contacting the electroconductive layer 42 forming the inner peripheral surface of the intermediary transfer belt 13.

By such a constitution, in the constitution in which the intermediary transfer belt 13 including the electroconductive layer 42 containing the copper compound forming the inner peripheral surface in order to improve the transfer property or the like is used and in which the aluminum rollers which are relatively inexpensive are used as the stretching rollers, the durability of the image forming apparatus 100 can be improved.

6. Evaluation Test

Next, a result of an evaluation test conducted for this embodiment (embodiment 1) and a comparison example will be described. In the comparison example, as each of the tension roller 14 and the auxiliary roller 19, the aluminum roller formed of the aluminum alloy of A6063 in alloy number, which has not been subjected to the alumite treatment was used. A constitution of the comparison example is substantially the same as the constitution of this embodiment except for this point. Incidentally, also as regards the comparison example, reference numerals or symbols which are the same as those in this embodiment are added, and description thereof will be made.

The evaluation test was conducted in the following manner. For each of the constitution of this embodiment and the constitution of the comparison example, the intermediary transfer belt 13 was stretched around the tension roller 14, the auxiliary roller 19, and the opposite roller 15 and was left standing for 3 days in a high-temperature/high-humidity environment of 60° C. in temperature and 85% RH in relative humidity. In that state, occurrence or non-occurrence of the folding between the electroconductive layer 42 and each of the tension roller 14 and the auxiliary roller 19, occurrence or non-occurrence of the folding of the intermediary transfer belt 13 when the intermediary transfer belt 13 is manually rotated, and occurrence or non-occurrence of the peeling-off of the electroconductive layer 42 were compared between this embodiment and the comparison example. The result of the evaluation test is shown in a table 1.

TABLE 1

| Item | EMB. 1 | COMP. EX. |
|---|---|---|
| Sticking | Not occurred | Occurred |
| Folding | Not occurred | Occurred |
| Peeling-off | Not occurred | Occurred |

In the constitution of the comparison example, the sticking occurred between the electroconductive layer 42 and each of the tension roller 14 and the auxiliary roller 19, and the folding of the intermediary transfer belt 13 and the peeling-off of the electroconductive layer 42 occurred. For that reason, it is understood that there is a possibility that the improvement in durability of the image forming apparatus 100 becomes difficult as described above. On the other hand, in the constitution of this embodiment, the sticking occurred between the electroconductive layer 42 and each of the tension roller 14 and the auxiliary roller 19, and the folding of the intermediary transfer belt 13 and the peeling-off of the electroconductive layer 42 did not occur. Accordingly, according to the constitution of this embodiment, it is understood that it becomes possible to realize the improvement in durability of the image forming apparatus 100.

Here, the above-described problem has a tendency that a degree of occurrence is conspicuous at a contact end portion, between the aluminum roller and the electroconductive layer 42 forming the inner peripheral surface of the intermediary transfer belt 13, where there are many opportunities of contact with the water content in the air. For that reason, it is preferable that occurrence of the above-described oxidation-reduction reaction is suppressed for all the aluminum rollers contacting the electroconductive layer 42 forming the inner peripheral surface of the intermediary transfer belt 13. Therefore, in this embodiment, the alumite layer was provided at the surfaces, contacting the electroconductive layer 42, of the tension roller 14 and the auxiliary roller 19 which are constituted by the aluminum rollers contacting the electroconductive layer 42. However, particularly, the aluminum roller with a large winding amount of the intermediary transfer belt 13 has a tendency that the aluminum roller is more affected by the sticking since a degree of close contact between the intermediary transfer belt 13 and the aluminum roller is strong. For that reason, for example, of the plurality of the aluminum rollers contacting the electroconductive layer 42, as regards the aluminum roller with a relatively large winding amount of the intermediary transfer belt 13 as in the case of the tension roller 14 in this embodiment, it is desired that the above-described oxidation-reduction reaction is more suppressed. Accordingly, for example, as in the case of the tension roller 14 in this embodiment, the alumite layer is provided at the surface, contacting the electroconductive layer 42, of at least one aluminum roller with the relatively large winding amount of the intermediary transfer belt 13, whereby it is possible to obtain a corresponding effect.

As described above, according to this embodiment, it is possible to realize the improvement in durability of the image forming apparatus 100 by providing the alumite layer through the alumite treatment of the surface, contacting the electroconductive layer 42 of the intermediary transfer belt 13, of each of the tension roller 14 and the auxiliary roller 19 which are constituted by the aluminum rollers.

Embodiment 2

Next, another embodiment of the present invention will be described. Basic constitution and operation of an image forming apparatus 100 of this embodiment are the same as those of the image forming apparatus 100 of the embodiment 1. Accordingly, in the image forming apparatus 100 of this embodiment, as regards elements having the same or corresponding functions and constitutions as those in the image forming apparatus 100 of the embodiment 1, reference numerals or symbols which are the same as those in the embodiment 1 are added and detailed description thereof will be omitted.

The sticking between the intermediary transfer belt 13 and the metal roller described in the embodiment 1 is caused by the oxidation-reduction reaction occurring due to a difference in ionization tendency between the copper ion from the copper compound and the metal of the metal roller. In the constitution of the embodiment 1, the aluminum of the aluminum roller is larger in ionization tendency than the copper.

Therefore, in this embodiment, the surface of the metal roller contacting the inner peripheral surface (electroconductive layer 42) of the intermediary transfer belt 13 is coated with metal close in ionization tendency to the copper than the metal of the base material of the metal roller is, so that a coating layer is formed at the surface of the metal roller. In this embodiment, at the surface of the metal layer, a plated layer is formed by plating (treatment). By this, it is possible to suppress the oxidation-reduction reaction between the copper and the metal of the base material of the metal roller. Further, by coating the metal roller surface with the metal, it is possible to ensure an energization property of the metal roller.

In this embodiment, the surface of each of the roller portions of the tension roller 14 and the auxiliary roller 19 which are constituted by aluminum rollers as the metal rollers and which contact the electroconductive layer 42 of the intermediary transfer belt 13 is subjected to plating (treatment) with nickel. By this, at each of the roller portions of the tension roller 14 and the auxiliary roller 19, a nickel-plated layer as the coating layer forming the surface contacting the electroconductive layer 42 of the intermediary transfer belt 13 is provided. Part (b) of FIG. 5 is a schematic sectional view (cross section substantially perpendicular to the rotational axis direction) showing a layer structure of a roller portion 60 of the tension roller 14 (auxiliary roller 19) in this embodiment. In this embodiment, the roller portion 60 of the tension roller 14 (auxiliary roller 19) includes a nickel-plated layer 63 forming a surface of a base material 61 formed of aluminum. In this embodiment, the roller portion 60 of the tension roller 14 (auxiliary roller 19) is provided with the coating layer (nickel-plated layer 63) on a surface of a full circumference of at least a portion (entire area with respect to the rotational axis direction in this embodiment) contacting the inner peripheral surface of the intermediary transfer belt 13. Incidentally, the nickel-plated layer is a layer principally comprising nickel formed by the plating. Further, the thickness of the coating layer (nickel-plated layer 63) in this embodiment can be set in conformity to the thickness of the alumite layer.

By this, it terms of a standard potential (a difference (in standard electrode potential) based on a potential (0 V) of a standard hydrogen electrode (herein, also referred to as a "standard potential difference"), relative to a standard potential difference of about 2.00 V between the aluminum and the copper, a standard potential difference of about 0.60 V between the nickel and the copper can be provided. Accordingly, by providing the nickel-plated layer, compared with the case where the nickel-plated layer is not provided, the oxidation-reduction reaction between the metal of the metal roller and the copper of the electroconductive layer 42 can be suppressed. Incidentally, the standard potential of the aluminum is −1.662 V, the standard potential of the nickel is −0.257 V, and the standard potential of the copper is 0.342 V.

The plating can be carried out using an available know method. For example, nickel plating on the aluminum material can be carried out through so-called electroless plating.

Here, in order to suppress the above-described oxidation-reduction reaction, the standard potential difference between the copper and the metal of the coating layer forming the surface of the metal roller contacting the electroconductive layer 42 of the metal roller may only be required to be smaller than the standard potential difference between the copper and the metal of the base material of the metal roller. However, in order to suppress the above-described oxidation-reduction reaction with reliability, the standard potential difference between the copper and the metal of the coating layer may preferably be made 0.80 V or less, more preferably be made 0.60 V or less. This standard potential difference may also be about 0 V.

Thus, in this embodiment, the image forming apparatus 100 includes rollers (the tension roller 14 and the auxiliary roller 19) which are rollers each including a roller portion which is disposed on the inner peripheral surface side of the intermediary transfer belt 13 and around which the intermediary transfer belt 13 is wound, and the roller portion is formed of the metal material and includes the base material 61 formed of a first metal material principally consisting of a first metal and the coating layer 63 formed, on the base material 61, of a second metal material principally consisting of a second metal forming the surface contacting the electroconductive layer 42 forming the inner peripheral surface of the intermediary transfer belt 13. The standard potential difference between the second metal and the copper is smaller than the standard potential difference between the first metal and the copper. Incidentally, formation of the metal material principally with a predetermined metal means that a content of the predetermined metal in the metal material is largest among metals which may be contained in the metal material. Further, in this embodiment, the coating layer is the plated layer formed through the plating but can also be intended to be formed by another method such as vapor deposition, thermal spraying, or the like. Further, in this embodiment, the above-described base material is formed of the aluminum material and the above-described coating layer is the nickel-plated layer, but the present invention is not limited to such an embodiment. For example, on a base material formed of a SUM (free-cutting steel), as the coating layer, a plated layer such as the nickel-plated layer may also be formed. Also, in this embodiment, the standard potential difference between the copper and the principal metal of the coating layer can be made smaller than the standard potential difference between the copper and the principal metal of the base material.

Similarly as the evaluation test described in the embodiment 1, an valuation test was carried out for a constitution of this embodiment (embodiment 2) and a constitution of a comparison example. In this embodiment, each of the tension roller 14 and the auxiliary roller 19 is constituted by an aluminum belt provided with the nickel-plated layer. In the comparison example, each of the tension roller 14 and the auxiliary roller 19 is constituted by an aluminum roller provided with no nickel-plated layer. Further, each of these aluminum rollers was left standing for 3 days in the high-temperature/high-humidity environment of a temperature of 60° C. and a relative humidity of 85% RH. Then, occurrence or non-occurrence of each of the sticking, the folding of the intermediary transfer belt 13 during manual rotation, and the peeling-off of the electroconductive layer 42 was compared between the above-described aluminum rollers. As a result, in the constitution of this embodiment, the sticking can be suppressed, and it was also possible to suppress the folding of the intermediary transfer belt 13 and the peeling-off of the electroconductive layer 42.

Further, the nickel-plated layer is capable of energization, and therefore, it is possible to suppress the occurrence of the above-described oxidation-reduction reaction while ensuring the energization property. The constitution of the embodiment 1 can be said that the constitution can be particularly suitably used for the roller to which these is no need to perform energization during the operation of the image forming apparatus 100 (typically, during the image formation). On the other hand, the constitution of this embodiment (embodiment 2) can be said that the constitution can be particularly suitably used for the roller to which there is a need to perform energization during the operation of the image forming apparatus 100 (typically, during the image formation). In this embodiment, the constitution of this embodiment was applied to the tension roller 14 and the auxiliary roller 19 unnecessary to perform the energization during the operation of the image forming apparatus 100, but can be applied to rollers, such as the primary transfer rollers 10 and the opposite roller 15, necessary to perform the energization during the operation of the image forming apparatus 100. That is, the primary transfer rollers 10 can be constituted by the metal belt such as the aluminum roller. Incidentally, in this case, each of the primary transfer rollers 10 may preferably be offset, for example, to a side downstream of the associated photosensitive drum 1 with respect to the movement direction of the intermediary transfer belt 13. Further, by this, with respect to the movement direction of the intermediary transfer belt 13, it is preferable that a contact region between the photosensitive drum 1 and the intermediary transfer belt 13 and a contact region between the intermediary transfer belt 13 and the primary transfer roller 10 do not overlap with each other.

Further, the opposite roller 15 can be constituted by the metal roller such as the aluminum roller. Incidentally, in this case, the driving roller for driving the intermediary transfer belt 13 may preferably be provided separately from the opposite roller 15. Thus, it is effective to perform the nickel plating on the surface of the primary transfer roller 10, the opposite roller 15, or the like contacting the electroconductive layer 42 of the metal roller used as a current passage during the operation of the image forming apparatus 100 (typically, during the image formation). In the case where the image forming apparatus 100 includes a plurality of metal rollers contacting the electroconductive layer 42 of the intermediary transfer belt 13, the constitution of this embodiment may also be applied to the metal roller necessary to perform the energization during the operation of the image forming apparatus 100, and the constitution of the embodiment 1 may also be applied to the metal roller unnecessary to perform the energization during the operation of the image forming apparatus 100. Further, it is preferable that the alumite layer according to the embodiment 1 or the coating layer according to this embodiment is provided on the surfaces of all the metal rollers contacting the electroconductive layer 42 of the intermediary transfer belt 13.

As described above, according to this embodiment, not only an effect similar to the effect of the embodiment 1 can be achieved, but also it is possible to ensure the energization property between the electroconductive layer 42 of the intermediary transfer belt 13 and the metal roller(s) contacting the electroconductive layer 42.

According to the present invention, it is possible to realize the improvement in durability of the image forming apparatus provided with the belt including the electroconductive layer forming the inner peripheral surface of the belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an endless belt including a base layer and an electroconductive layer positioned on an inner peripheral surface side of said base layer and forming an inner peripheral surface of said belt; and a roller provided on the inner peripheral surface side of said belt and including a roller portion around which said belt is wound and which is formed of a metal material, wherein said electroconductive layer contains a binder resin, an electroconductive agent, and a copper compound, and has surface resistivity of $5.0\times10^{6}\Omega/\square$ or less, wherein said roller portion includes a base material formed of a first metal material comprising a first metal, and a coating layer which forms a surface contacting said electroconductive layer and which is formed of a second metal material comprising a second metal, and wherein a difference in standard potential between the second metal and copper is smaller than a difference in standard potential between the first metal and the copper.

2. The image forming apparatus according to claim 1, wherein the difference in standard potential between the second metal and the copper is 0.80 V or less.

3. The image forming apparatus according to claim 1, wherein said coating layer is a plated layer.

4. The image forming apparatus according to claim 1, wherein said base material is formed of an aluminum material, and said coating layer is a nickel-plated layer.

5. The image forming apparatus according to claim 1, wherein said roller is a roller necessary to perform energization during an operation of said image forming apparatus.

6. The image forming apparatus according to claim 1, wherein said binder resin includes a polyester resin having a monomer unit derived from at least two phthalic acids selected from the group consisting of terephthalic acid, orthophthalic acid, and isophthalic acid.

7. The image forming apparatus according to claim 1, wherein said electroconductive agent includes carbon black.

8. The image forming apparatus according to claim 1, wherein a content of said copper compound in said electroconductive layer is 1.0 weight % to 13.5 weight %.

9. The image forming apparatus according to claim 1, wherein said base layer includes a polyester resin.

10. The image forming apparatus according to claim 1, wherein said belt is an intermediary transfer belt fed for secondary-transferring, onto a recording material, a toner image primary-transferred from an image bearing member by a current flown through said belt in a circumferential direction of said belt.

* * * * *